US009150022B2

(12) United States Patent
Miyakoshi et al.

(10) Patent No.: US 9,150,022 B2
(45) Date of Patent: Oct. 6, 2015

(54) PRINTING APPARATUS

(71) Applicant: CANON KABUSHIKI KAISHA, Tokyo (JP)

(72) Inventors: Arihito Miyakoshi, Tokyo (JP); Masahiko Kubota, Tokyo (JP); Nobuhito Yamaguchi, Inagi (JP); Hiroshi Arimizu, Kawasaki (JP); Koichi Ishida, Tokyo (JP); Yoshinori Itoh, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/493,900

(22) Filed: Sep. 23, 2014

(65) Prior Publication Data

US 2015/0085015 A1 Mar. 26, 2015

(30) Foreign Application Priority Data

Sep. 24, 2013 (JP) ..... 2013-197204
Aug. 22, 2014 (JP) ..... 2014-169769

(51) Int. Cl.

| | |
|---|---|
| ***B41J 2/165*** | (2006.01) |
| ***B41J 2/17*** | (2006.01) |
| ***B41J 13/02*** | (2006.01) |

(52) U.S. Cl.
CPC ..... *B41J 2/16585* (2013.01); *B41J 2/1714* (2013.01); *B41J 13/02* (2013.01)

(58) Field of Classification Search
None
See application file for complete search history.

(56) References Cited

U.S. PATENT DOCUMENTS

2006/0238561 A1* 10/2006 Carcia et al. ..... 347/30
2010/0224693 A1* 9/2010 Koike et al. ..... 239/1

* cited by examiner

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

Air blown out from one blowing-out opening of a pinch roller which is within a predetermined angle range forms an air flow of a flow rate Fc which heads for a region between a suction mechanism and a print medium. This makes it possible to efficiently guide the air blown out from the blowing-out opening into the region, and as a result, ink mist can be collected satisfactorily even in a case where the amount of air blown from the pinch roller is relatively small. Further, in this case, the flow rate Fe of a flow blown from the pinch roller is appropriately determined, whereby the suction mechanism can collect substantially 100% of air and ink mist flowing into the region.

12 Claims, 10 Drawing Sheets

PRINTING APPARATUS

BACKGROUND OF THE INVENTION

1. Field of the Invention

The present invention relates to a printing apparatus for performing printing by ejecting liquid such as an ink, and particularly relates to a technique of controlling, with an air flow, ink mist which may be generated in a case where an ink is ejected from a liquid ejection head.

2. Description of the Related Art

As an example of this kind of technique, United States Patent Laid-Open No. 2006/0238561 describes providing a supply part for supplying an air flow to a position where mist may be generated and a suction part for sucking air, thereby generating an air flow from the mist generation position to the suction part. This arrangement can efficiently lead generated mist with the air flow into the suction part and prevent mist from landing on a surface of a liquid ejection head on which ejection openings are formed to affect ink ejection and from landing on an apparatus to stain the apparatus or printing paper.

However, the feature of controlling ink mist as disclosed in United States Patent Laid-Open No. 2006/0238561 has a problem that air supplied from the supply part is not efficiently used to remove mist. More specifically, in the mist control feature disclosed in United States Patent Laid-Open No. 2006/0238561, the air flow from the supply part is blown in a direction substantially perpendicular to a conveyed print medium as described later with reference to FIG. 10. Accordingly, about half of the blown air flow heads for a suction opening of the suction mechanism, and makes it impossible to generate an air flow which efficiently heads for the suction opening. As a result, for example, there is a case where in order to secure a necessary amount of an air flow heading for the suction opening of the suction mechanism, a large amount of air needs to be supplied.

SUMMARY OF THE INVENTION

An object of the present invention is to provide a printing apparatus capable of efficiently collecting ink mist even in a case where a relatively small amount of air is blown.

In a first aspect of the present invention, there is provided a printing apparatus using a liquid ejection head for ejecting liquid to perform printing by ejecting liquid on a print medium which is relatively conveyed with respect to the liquid ejection head, the printing apparatus comprising: a suction mechanism provided downstream of the liquid ejection head in a direction of the conveyance of the print medium; and a roller for conveying the print medium, the roller being provided downstream of the suction mechanism in the direction of the conveyance, wherein the roller includes a blowing-out mechanism for blowing out gas in a direction of the suction mechanism.

In a second aspect of the present invention, there is provided a printing apparatus comprising: a roller for contacting with a print medium to convey the print medium; a liquid ejection head for ejecting liquid on the print medium, the liquid ejection head being provided upstream of the roller in a direction of the conveyance of the print medium; and a suction opening provided between the roller and the liquid ejection head in the direction of the conveyance, wherein the roller includes a blowing-out opening for blowing out gas toward a side upstream of a portion of the roller which is in contact with the print medium in the direction of the conveyance.

According to the above features, it becomes possible to efficiently collect ink mist even in a case where a relatively small amount of air is blown to collect ink mist.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

First Embodiment

Figure 1:
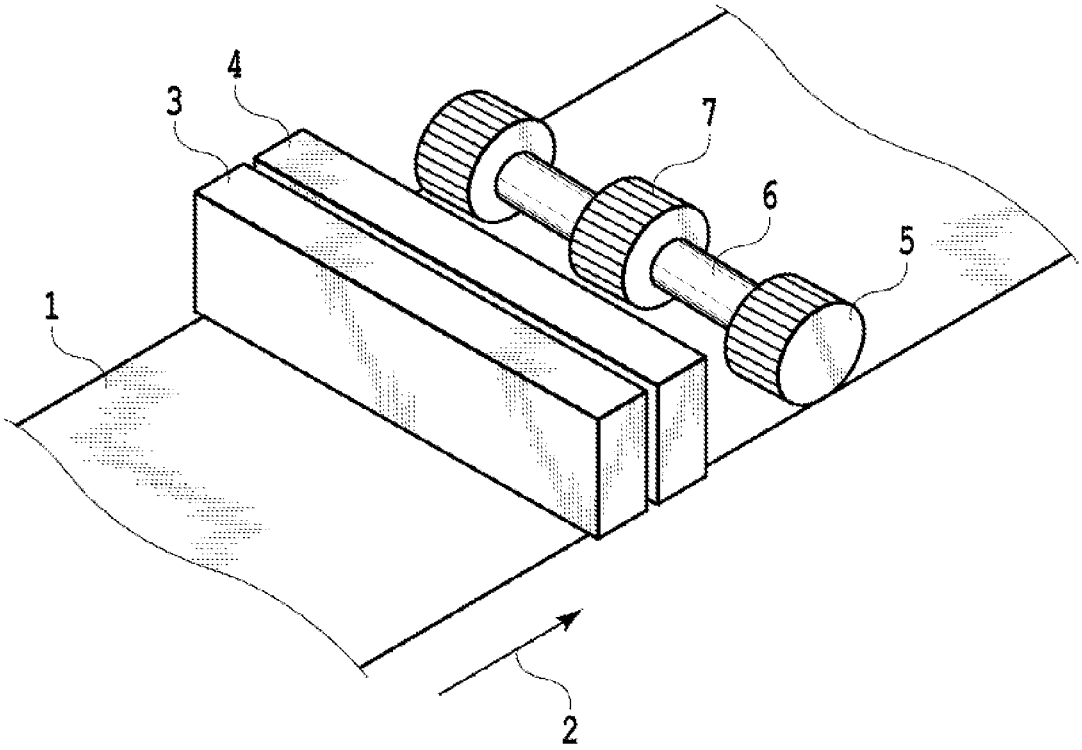
FIG. 1 is a perspective view schematically showing, in particular, a structure for collecting ink mist of a printing apparatus of a first embodiment of the present invention.
Figure 2:
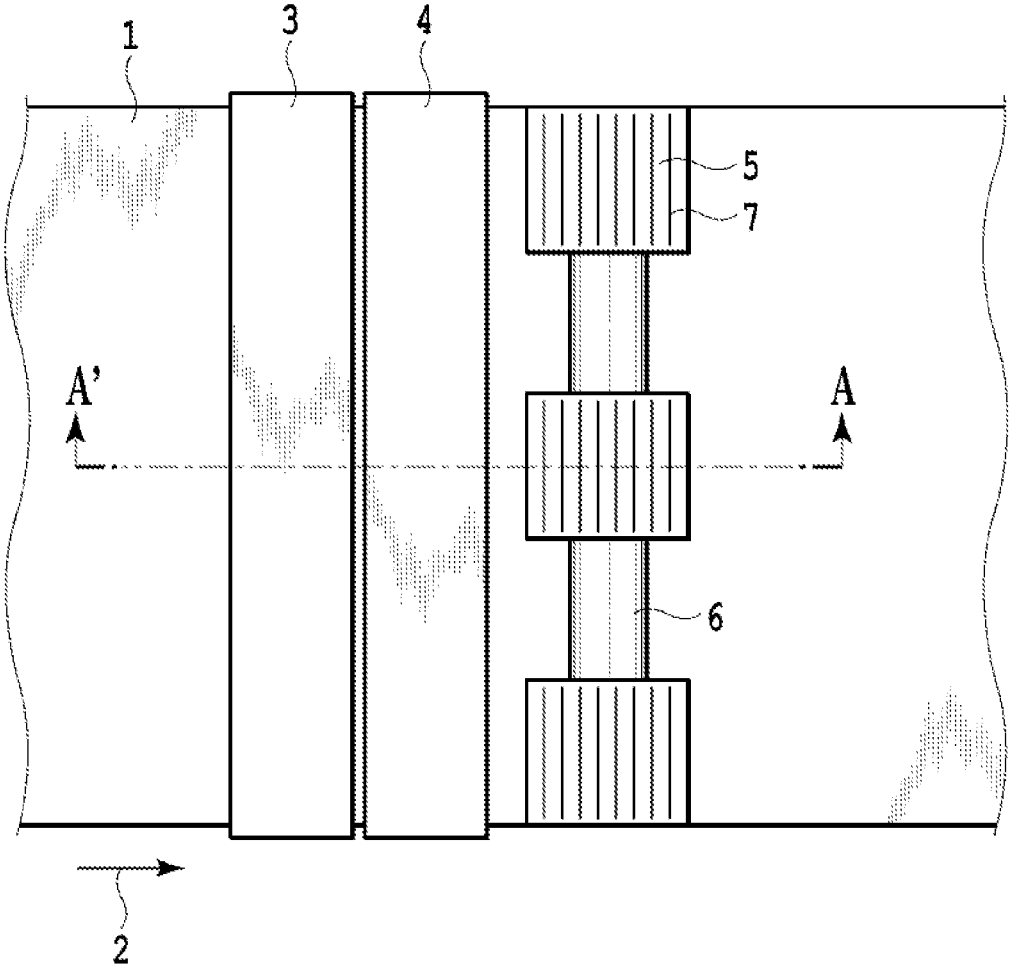
FIG. 2 is a plan view of the structure shown in FIG. 1 as viewed vertically from above relative to a print medium.

FIG. 1 is a perspective view schematically showing, in particular, a structure for collecting mist (ink mist), which is generated in a case where liquid such as an ink is ejected by a liquid ejection head, in a printing apparatus of a first embodiment of the present invention. FIG. 2 is a plan view of the structure shown in FIG. 1 as viewed vertically from above relative to a print medium. Further, FIG. 3 is a cross-sectional view taken on line A-A' of FIG. 2.

As shown in these figures, the printing apparatus of the present embodiment includes: a conveying mechanism for conveying a print medium 1 in a direction shown by an arrow 2 in the figures; and a liquid ejection head 3 of a so-called full line type in which a plurality of ink ejection openings are arranged along the width of the print medium to be conveyed. The liquid ejection head 3 is provided with six arrays of ejection openings for ink colors. A suction mechanism 4 is provided downstream of the liquid ejection head 3 in a relative conveyance direction of the print medium relative to the liquid ejection head 3, and can suck ink mist which is generated by ejection of an ink 11 from the liquid ejection head 3 as described later with reference to FIG. 4 or the like. The suction mechanism 4 includes: a suction opening 9; and a suction flow passage for discharging air and ink mist which are sucked through the suction opening into the outside of the apparatus. A driving part (not shown) generates negative pressure to perform the suction through the suction opening 9.

Further, pinch rollers 5 are provided downstream of the suction mechanism 4 in the conveyance direction of the print medium. More specifically, the conveying mechanism for conveying the print medium of the present embodiment includes: a belt (not shown) running around a predetermined range; and a plurality of rollers for pressing the print medium 1 against the belt and generating conveying force, the rollers being provided along the belt. Each pinch roller 5 which is one of these rollers is provided with a blowing-out opening 7 for blowing air (gas). In the present embodiment, the blowing-out opening is rectangular, and a plurality of rectangular blowing-out openings 7 are provided on the peripheral surface of the pinch roller 5. In the present embodiment, the plurality of blowing-out openings 7 are arranged and formed in parallel along a longitudinal direction of the pinch roller 5 in the shape of slits. The blowing-out openings 7 may be formed on a contact surface of the pinch roller 5 which is to be in contact with the print medium 1 or may be formed on a surface which is concave with respect to the contact surface. Further, a gas supply unit (not shown) is provided at a predetermined position in the printing apparatus of the present embodiment, and air is supplied from this supply unit to the inside of each pinch roller through a tube (not shown) connected to a hollow shaft 6 for the pinch roller 5. Inside each pinch roller, a supply opening having a shape substantially identical to that of the blowing-out opening 7 is provided at a position opposite to the rotating blowing-out opening 7. This enables each blowing-out opening 7 to be aligned with the supply opening during the rotation of the pinch roller and to blow air at a predetermined rotation position θ described later with reference to FIG. 3.

Figure 3:
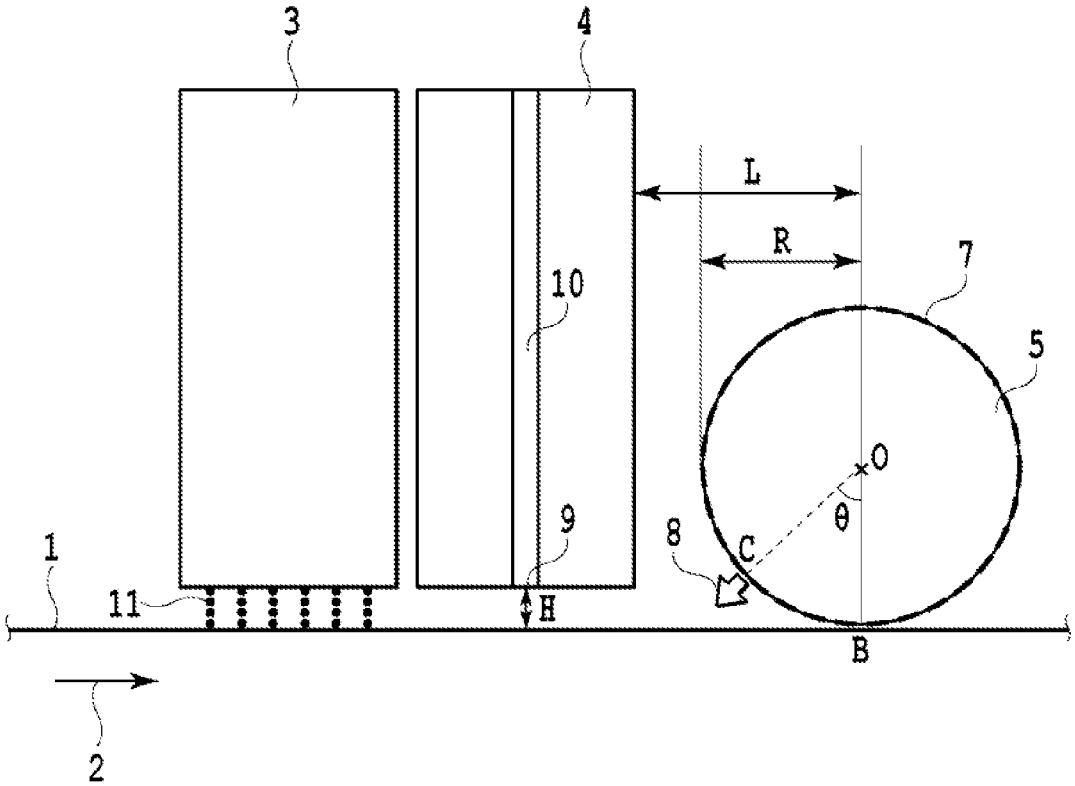
FIG. 3 is a cross-sectional view taken on line A-A' of FIG. 2.

FIG. 3 is a diagram for explaining which blowing-out opening 7 in the pinch roller generates (blows out) an air flow. In FIG. 3, a reference sign O designates the center of the pinch roller 5, a reference sign C designates the position of the blowing-out opening 7, a reference sign B designates a point of contact between the pinch roller 5 and the print medium 1, a reference sign R designates the radius of the pinch roller 5, a reference sign L designates a distance between the center of the pinch roller 5 and a side wall of the suction mechanism 4, a reference sign H designates a distance between the suction opening 9 and the print medium 1, and a reference sign θ designates an angle between a line segment OB and a line segment OC.

Air 8 blown out from one blowing-out opening 7 at the predetermined rotation position θ within a range represented by the following expression (1) heads for space having the height H between a lower side of the suction mechanism 4 and the print medium 1.

$$0° < \theta \leq 90° - \tan^{-1}((R-H)/L) \quad (1)$$

An angle represented by $90° - \tan^{-1}((R-H)/L)$ is an angle between the line segment OB and a line segment connecting a lower right corner of the suction mechanism 4 in FIG. 3 and the center O of the pinch roller. In this manner, the present embodiment achieves advantageous results in a case where air is blown out from the one blowing-out opening 7 at the rotation position θ represented by the above expression (1). The blowing-out openings 7 at positions other than the rotation position θ may or may not blow out air. In other words, it is only necessary that air be blown out from at least one blowing-out opening 7 at the rotation position θ. Further, air may be blown out continuously and control may be performed so that blowing out is stopped at positions other than the above rotation position θ.

Figure 4:
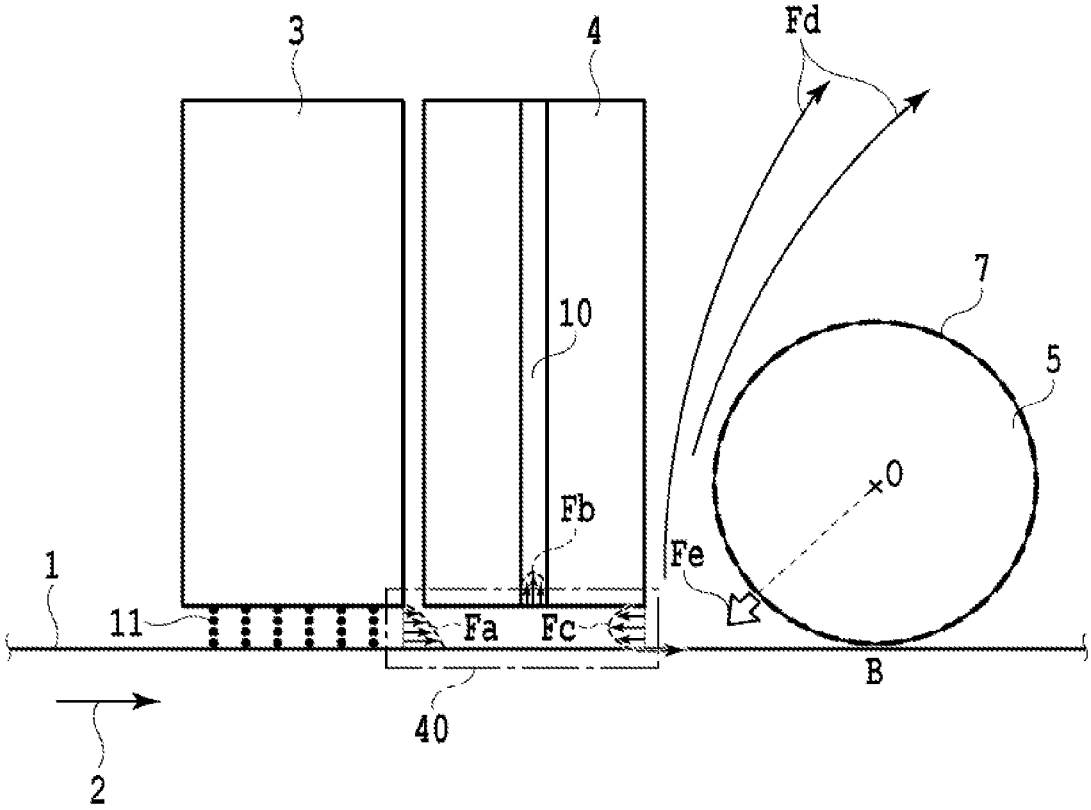
FIG. 4 is a diagram for explaining an air flow rate in each section in the mist collection structure shown in FIG. 3 and a relationship among the air flow rates.

FIG. 4 is a diagram for explaining an air flow rate in each section in the mist collection structure of the present embodiment shown in FIG. 3 and a relationship among the air flow rates.

In a flow system for air for collecting mist (and ink mist) as shown in FIG. 4, the flow rate of air (and ink mist) flowing into this system is the sum of the flow rate Fa of a flow generated by conveyance of the print medium 1 and the flow rate Fe of air blown out from the one blowing-out opening 7 of the pinch roller 5. Further, the flow rate of air (and ink mist) flowing out of the system is the sum of the flow rate Fb of air (and ink mist) discharged from the suction mechanism via the suction flow passage 10 of the suction mechanism 4 and the flow rate Fd of an air flow which is part of air blown out from the pinch roller and the like and which does not flow into a region 40 below the suction mechanism 4. Since the flow rate of the flow flowing into the flow system is equal to the flow rate of the flow flowing out of the flow system according to the mass conservation law, the following expression (2) is established.

$$Fa+Fe=Fb+Fd \quad (2)$$

In order to collect all air (and ink mist) flowing into the region 40 below the suction mechanism 4 via the suction flow passage 10, the air flow flowing into the region 40 from a right side in FIG. 4 must not have a velocity component in a right direction in FIG. 4 (a velocity component flowing out of the region 40). This condition is also a condition for establishment of the following expression (3) for the flow rates Fc and Fa of the air flows flowing into the region 40.

$$Fc>Fa \quad (3)$$

A condition for the flow rate Fe of the air blown out from the pinch roller 5 is represented by the following expression (4) based on the expression (2) and the expression (3). Incidentally, in the present embodiment, the flow rate Fe is the flow rate of air blown out from three rollers.

$$Fe>Fb+Fd-Fc \quad (4)$$

In the mist collection mechanism of the present embodiment, air blown out from one blowing-out opening 7 of the pinch roller 5 which is within a predetermined angle range forms an air flow which heads for the region 40 formed between the suction mechanism 4 and the print medium 1 and which has the flow rate Fc. This makes it possible to efficiently lead air blown out from the blowing-out opening into the region 40, and as a result, even in a case where the amount of air blown out from the pinch roller is relatively small, ink mist can be collected satisfactorily. Further, in this case, the flow rate Fe of the flow flowing from the pinch roller is determined according to the expression (4), whereby the suction mechanism 4 can efficiently collect a large portion (80% or more) of air (and ink mist) flowing into the region 40.

Incidentally, as a distance between the suction mechanism and the pinch roller becomes larger, the precision of conveyance of a print medium becomes smaller, and accordingly, it is desirable to reduce the distance between the pinch roller and the suction mechanism. Further, in a case where the distance between the pinch roller and the suction mechanism becomes too small, it is difficult to remove a worn-out pinch roller to be replaced. Accordingly, the distance between the pinch roller and the suction mechanism is preferably set at a value such that high conveyance precision can be maintained and the pinch roller can be removed easily.

In the present embodiment, the distance H between the suction opening and the print medium is 1.5 mm, the conveyance speed of the print medium is 0.2 m/s, the distance L between the center of the pinch roller and the side wall of the suction mechanism is 10 mm, and a distance between the side wall of the suction mechanism and the suction opening is 5 mm. Further, the radius R of the pinch roller is 5.5 mm, the width of the blowing-out opening is 500 μm, the length of the blowing-out opening is 100 mm, and the arrangement pitch of the blowing-out opening is 15°. Further, the speed of blown out air is 10 m/s, and a predetermined angle (predetermined rotation position) θ between the line segment OB and the line segment OC is 45°. Further, the width of the suction opening is 500 μm, the length of the suction opening is 300 mm, and a suction speed is 0.2 m/s. In this case, the rate of collection of ink mist by the suction mechanism is substantially 100%.

Figure 10:
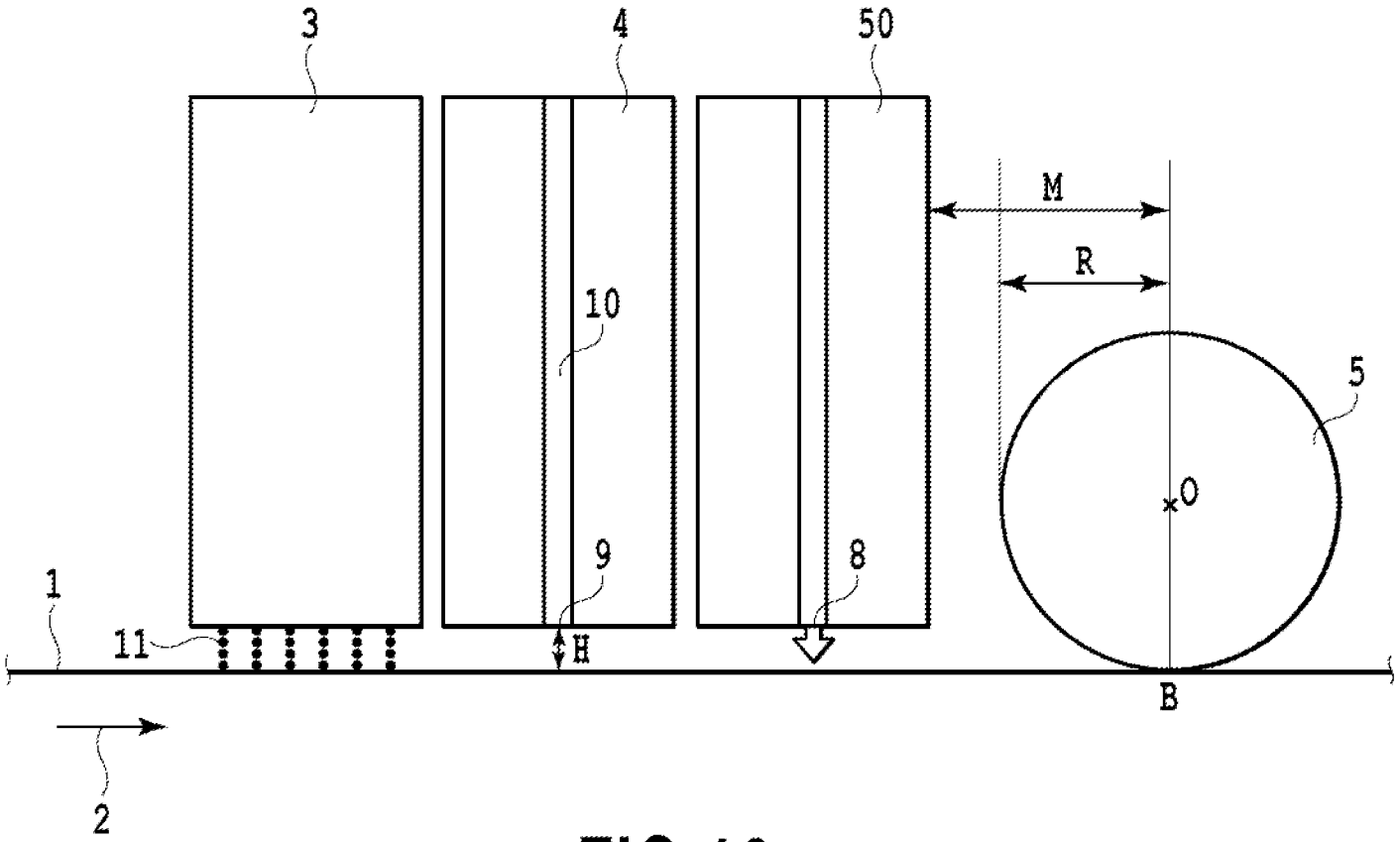
FIG. 10 is a diagram showing a structure of a conventional technique for collecting ink mist.

On the other hand, in the invention of United States Patent Laid-Open No. 2006/0238561, as disclosed in FIG. 10, a blowing-out mechanism 50 is provided downstream of the suction mechanism 4 and upstream of the pinch roller. In this arrangement, the following setting can be made, for example. A distance H between the suction opening of the suction mechanism 4 and the print medium is 1.5 mm, the conveyance speed of the print medium is 0.2 m/s, a distance between the center of the pinch roller and a side wall of the blowing-out mechanism is 10 mm, a distance between the side wall of the blowing-out mechanism and the blowing-out opening is 5 mm, and a distance between the blowing-out opening and the suction opening is 10 mm. Further, regarding blowing-out features, the speed of blown out air is 10 m/s, the width of the blowing-out opening is 500 μm, and the length of the blowing-out opening is 300 mm. Regarding suction features, the width of the suction opening is 500 μm, the length of the suction opening is 300 mm, and the suction speed is 0.2 m/s. As a result of measuring the rate of collection of ink mist under these conditions, it is found that the rate of collection is about 80%.

As described above, according to the present embodiment, it becomes possible to realize a high collection rate with a relatively small amount of blown out air.

Second Embodiment

Figure 5:
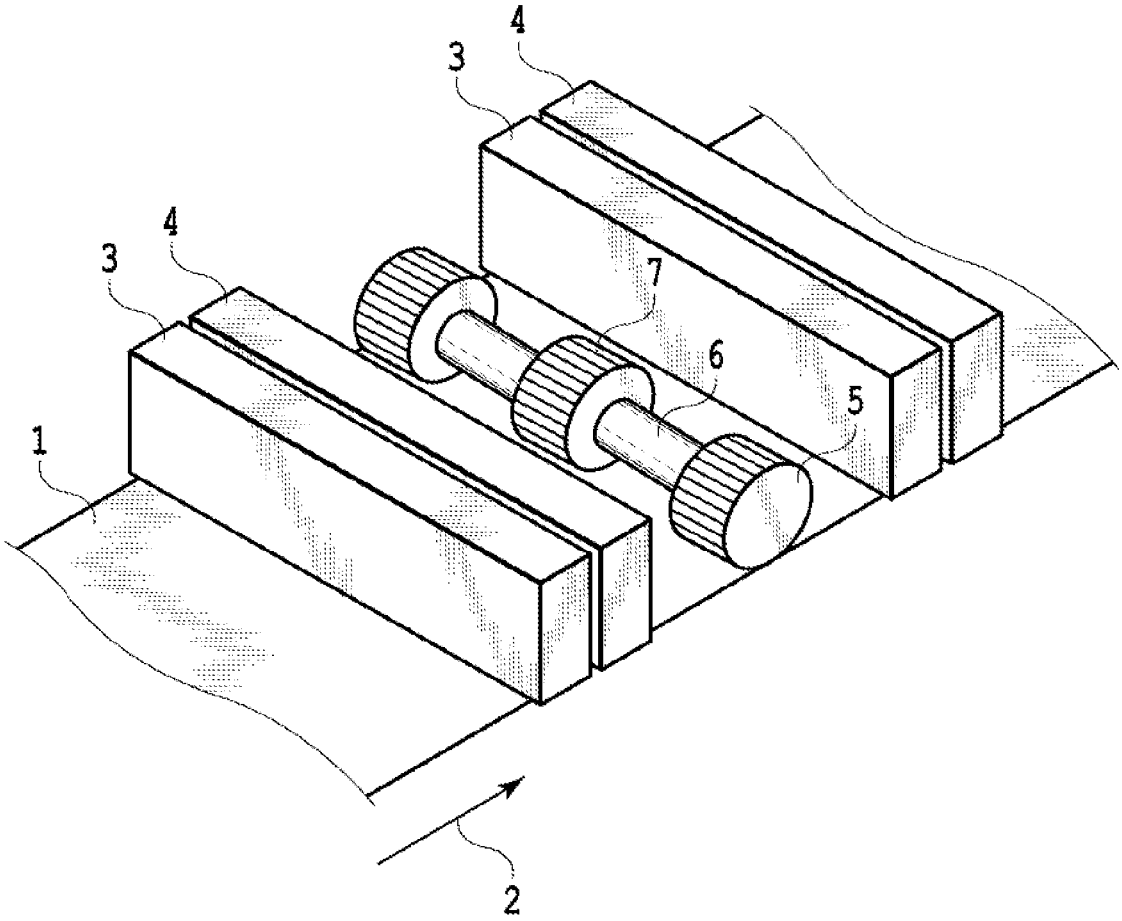
FIG. 5 is a perspective view showing a structure for collecting ink mist of a printing apparatus of a second embodiment of the present invention.
Figure 6:
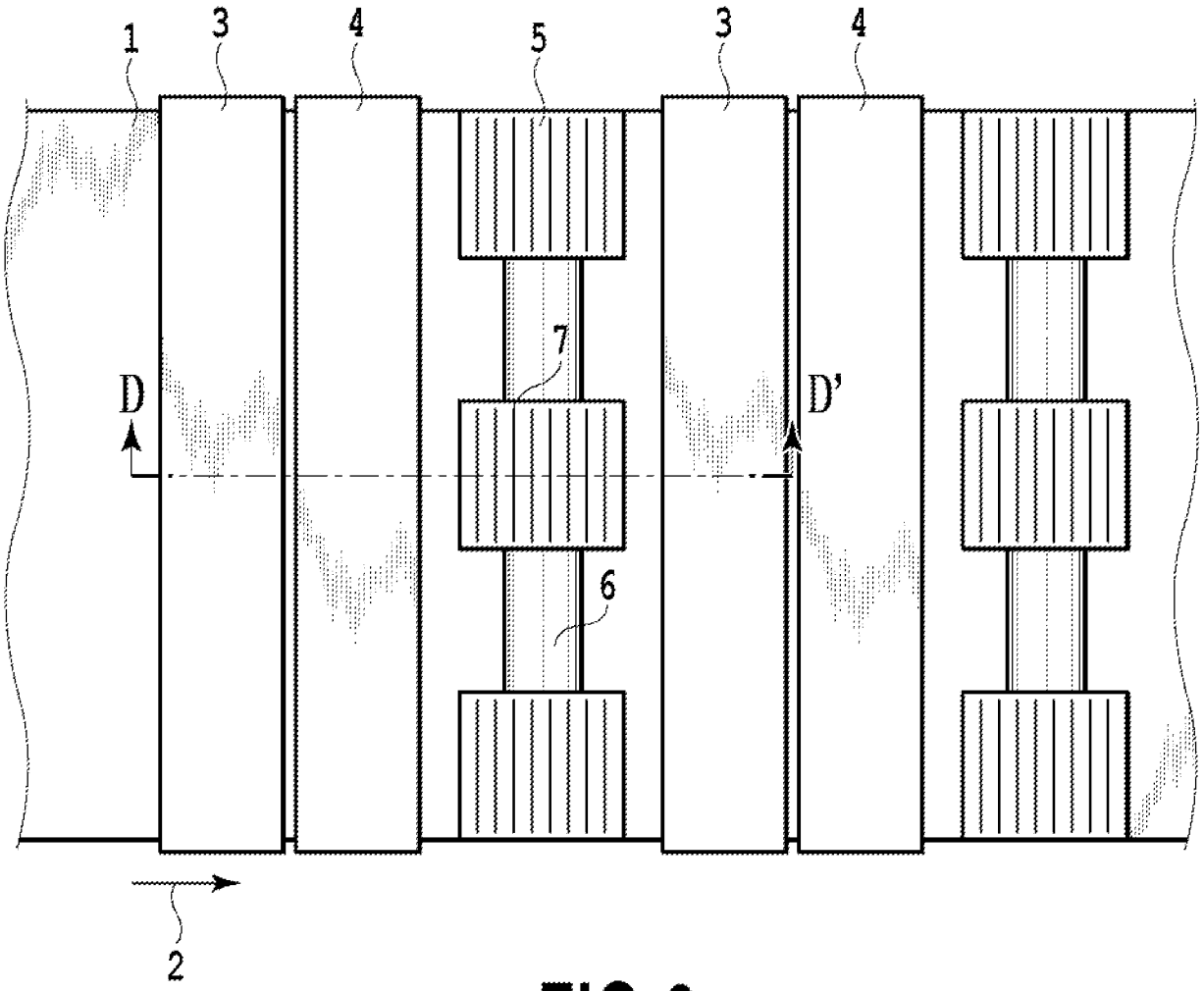
FIG. 6 is a plan view of the structure shown in FIG. 5 as viewed from above relative to a print medium 1.

FIG. 5 is a perspective view showing a structure for collecting ink mist in a printing apparatus of a second embodiment of the present invention. FIG. 6 is a plan view of the structure shown in FIG. 5 as viewed from above relative to a print medium 1. Further, FIG. 7 is a cross-sectional view taken on line D-D' of FIG. 6.

As shown in these figures, the present embodiment is different from the above first embodiment in that in addition to a set of the liquid ejection head 3, the suction mechanism 4, and the pinch roller 5, another set of a liquid ejection head, a suction mechanism, and a pinch roller is provided downstream in the conveyance direction of the print medium 1.

Figure 7:
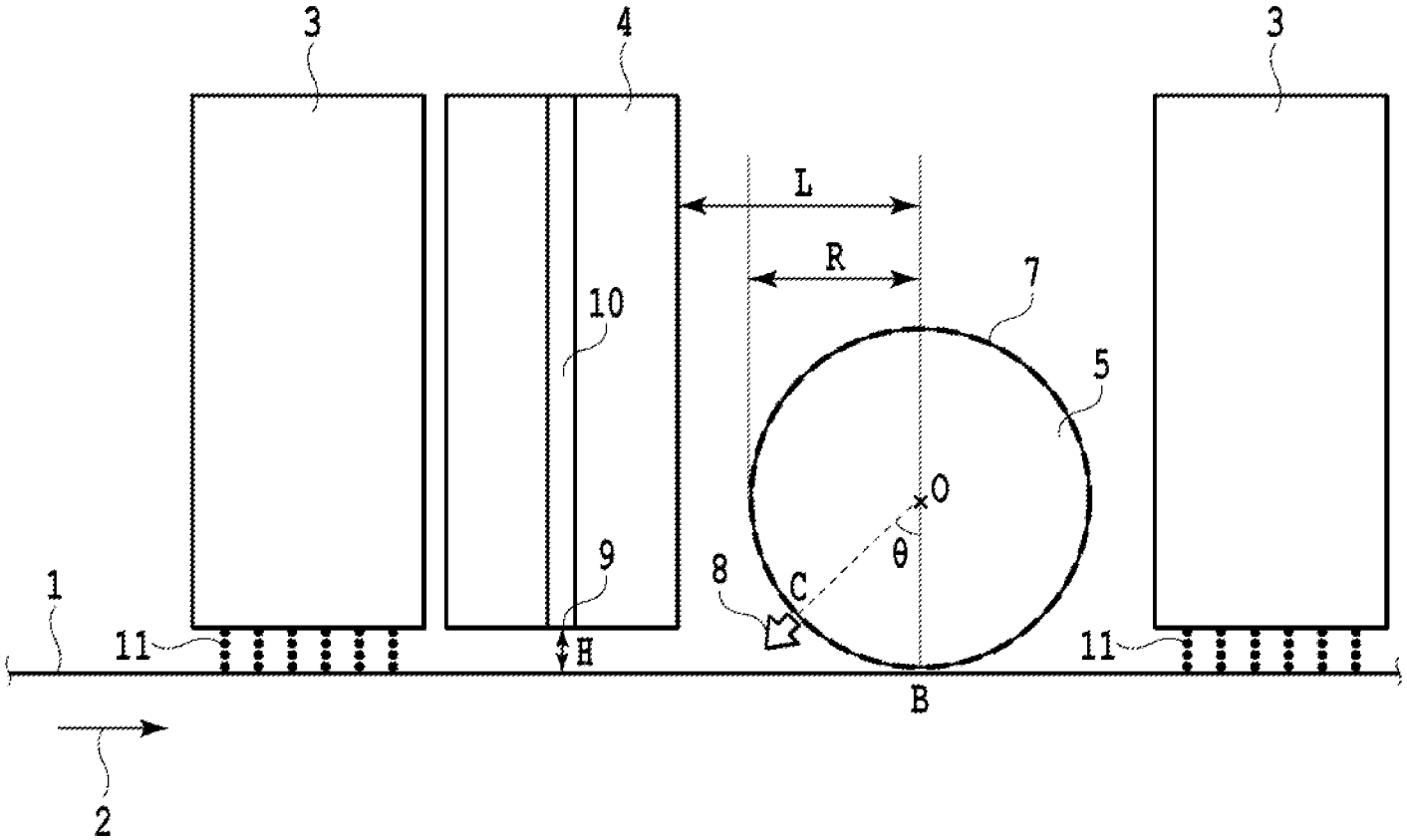
FIG. 7 is a cross-sectional view taken on line D-D' of FIG. 6.

As shown in FIG. 7, air is blown out from one of the plurality of blowing-out openings 7 of each pinch roller 5 which is at the predetermined rotation position θ within a range satisfying the above expression (1), as in the first embodiment.

Figure 8:
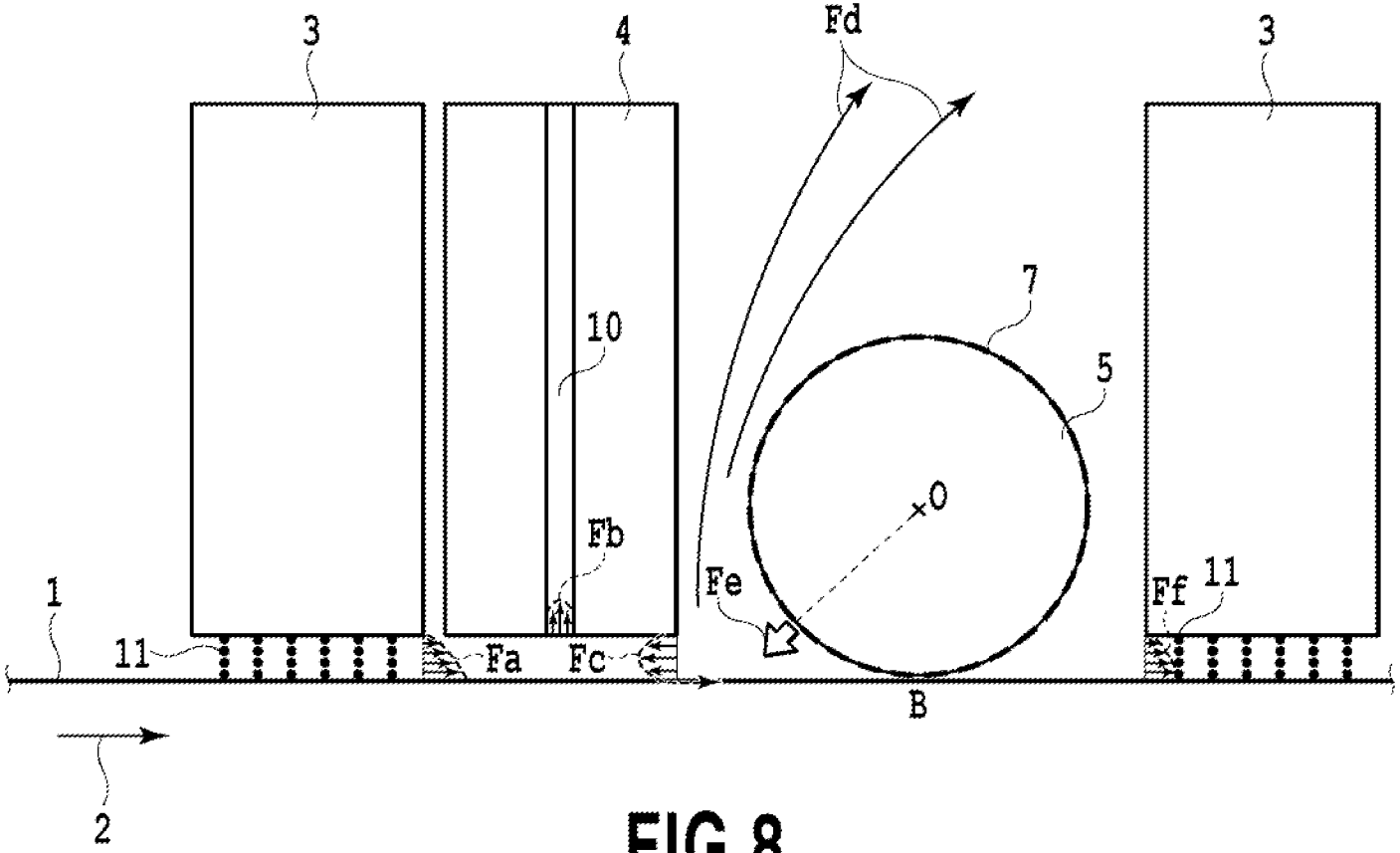
FIG. 8 is a diagram for explaining an air flow rate in each section of the present embodiment in the mist collection structure shown in FIG. 6 and a relationship among the air flow rates.

FIG. 8 is a diagram for explaining an air flow rate in each section of the present embodiment and a relationship among the air flow rates.

In an air flow system for collecting mist (and ink mist) as shown in FIG. 8, the flow rate of air (and ink mist) flowing into this system is the sum of the flow rate Fa of the flow generated by the conveyance of the print medium 1 and the flow rate Fe of air blown from the one blowing-out opening 7 of the pinch roller 5 as in the first embodiment. Further, the flow rate of air (and ink mist) flowing out of the system is the sum of the flow rate Fb of air (and ink mist) discharged from the suction mechanism via the suction flow passage 10 of the suction mechanism 4, the flow rate Fd of the air flow which is part of air blown out from the pinch roller and the like and which does not flow into the region 40 below the suction mechanism 4, and the flow rate Ff of a flow flowing into a region between the adjacent liquid ejection head (at a right side in the figure) and the print medium 1. Since the flow rate of the flow flowing into the flow system is equal to the flow rate of the flow flowing out of the flow system according to the mass conservation law, the following expression (5) is established.

$$Fa+Fe=Fb+Fd+Ff \tag{5}$$

As in the first embodiment, in order to collect all air (and ink mist) flowing into the region below the suction mechanism 4 via the suction flow passage 10, the following expression (6) must be satisfied.

$$Fc>Fa \tag{6}$$

A condition for the flow rate Fe of the air blown out from the pinch roller 5 is represented by the following expression (7) based on the expression (5) and the expression (6). Incidentally, in the present embodiment, the flow rate Fe is the flow rate of air blown from three rollers.

$$Fe>Fb+Fd+Ff-Fc \tag{7}$$

Under this condition, an air flow from the print medium 1 to the suction opening 9 can be generated by combining the feature of blowing air from the pinch roller 5 with the feature of sucking air by the suction mechanism 4, even in a case where the amount of the blown air 8 is relatively small. As a result, it becomes possible to realize efficient collection by leading ink mist floating near the print medium 1 into the suction opening 9.

Third Embodiment

Figure 9:
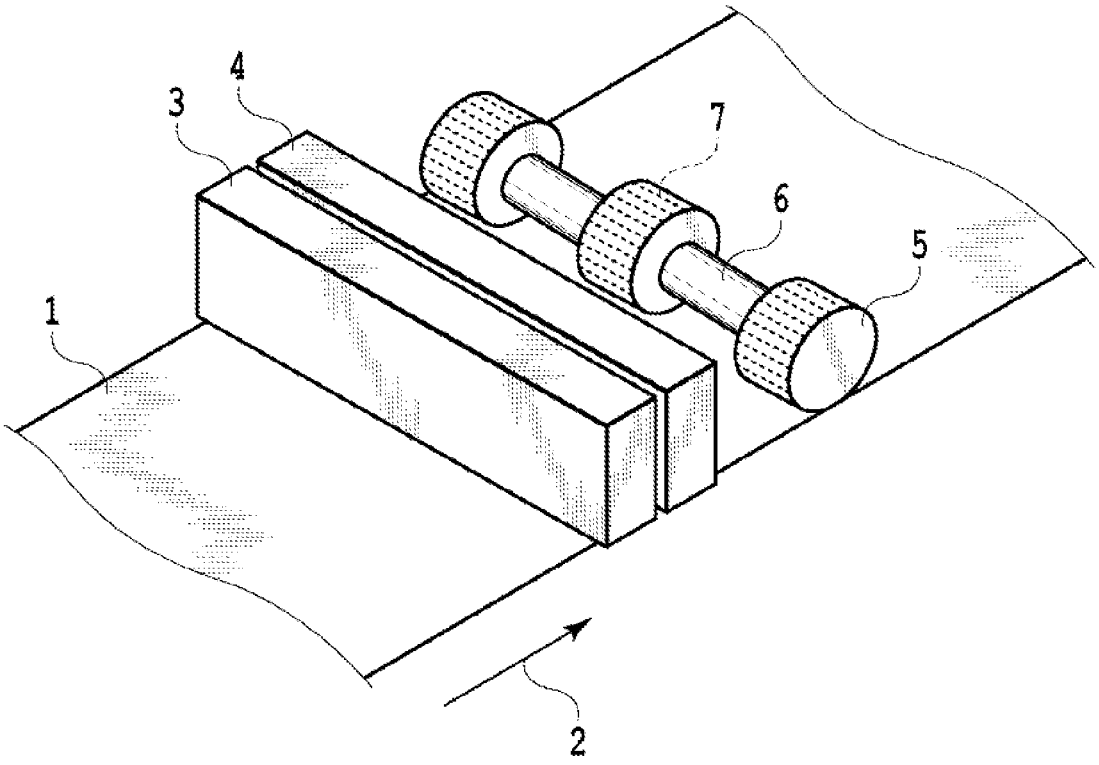
FIG. 9 is a perspective view schematically showing, in particular, a structure for collecting ink mist of a printing apparatus of a third embodiment of the present invention.

The blowing-out openings 7 of the above embodiments are rectangular, but naturally, the present invention is not limited to this form. As shown in FIG. 9, the blowing-out openings may be circular openings. The circular blowing-out openings are arranged on the peripheral surface of the pinch roller 5 in a direction perpendicular to the conveyance direction of the print medium and in the circumferential direction of the pinch roller. The blowing-out openings 7 are configured such that air is blown out from the circular openings which are at the predetermined angle position (rotation position) θ within a range specified by the above expression (1). In this case, it is desirable that the flow rate Fe satisfy the above expression (4).

Under this condition, the feature of blowing air from the pinch roller 5 is combined with the feature of sucking air by the suction mechanism 4, whereby it is possible to generate the air flow from the print medium 1 to the suction opening 9 even in a case where the amount of blown out air is relatively small. As a result, it becomes possible to realize efficient collection by leading ink mist floating near the print medium 1 into the suction opening 9.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-197204, filed on Sep. 24, 2013, and No. 2014-169769, filed on Aug. 22, 2014, which are hereby incorporated by reference herein in their entirety.

What is claimed is:

1. A printing apparatus using a liquid ejection head for ejecting liquid to perform printing by ejecting liquid on a print medium which is relatively conveyed with respect to the liquid ejection head, the printing apparatus comprising:

a suction mechanism provided downstream of the liquid ejection head with respect to a direction of the conveyance of the print medium; and a roller for conveying the print medium, the roller being provided downstream of the suction mechanism with respect to the direction of the conveyance, wherein the roller includes a blowing-out mechanism for blowing out gas in a direction of the suction mechanism.

2. The printing apparatus according to claim 1, wherein the blowing-out mechanism of the roller blows out gas from a blowing-out opening provided on a peripheral surface of the roller in a direction of a region between the suction mechanism and the conveyed print medium.

3. The printing apparatus according to claim 2, wherein the blowing-out opening is located at a predetermined rotation position θ within a range represented by the expression:

$$0°<\theta\leq 90°-\tan^{-1}((R-H)/L)$$

where a reference sign O designates the center of the roller, a reference sign C designates the position of the blowing-out opening, a reference sign B designates a point of contact between the roller and the print medium, a reference sign R designates a radius of the roller, a reference sign L designates a distance between the center of the roller and the suction mechanism, H designates a distance between a suction opening of the suction mechanism and the print medium, and θ designates an angle between a line segment OB and a line segment OC.

4. The printing apparatus according to claim 1, wherein a flow rate Fe of gas blown out from the roller satisfies the expression $$Fe>Fb+Fd-Fc$$

where Fb is a flow rate of gas discharged from the suction mechanism, and Fd−Fc is a flow rate of gas which does not flow into a region between the suction mechanism and the print medium.

5. The printing apparatus according to claim 1, wherein a flow rate Fe of gas blown out from the roller satisfies the expression $$Fe>Fb+Fd+Ff-Fc$$

where Fb is a flow rate of gas discharged from the suction mechanism, Fd−Fc is a flow rate of gas which does not flow into a region between the suction mechanism and the print medium, and Ff is a flow rate of a flow which flows into a region between an adjacent liquid ejection head and the print medium.

6. The printing apparatus according to claim 1, wherein the blowing-out mechanism has a plurality of blowing-out openings provided on a peripheral surface of the roller.

7. A printing apparatus comprising:

a roller for contacting with a print medium to convey the print medium;

a liquid ejection head for ejecting liquid on the print medium, the liquid ejection head being provided upstream of the roller with respect to a direction of the conveyance of the print medium; and a suction opening provided between the roller and the liquid ejection head with respect to the direction of the conveyance, wherein the roller includes a blowing-out opening for blowing out gas toward a side upstream of a portion of the roller which is in contact with the print medium with respect to the direction of the conveyance.

8. The printing apparatus according to claim 7, wherein the blowing-out opening extends in a direction crossing the direction of the conveyance.

9. The printing apparatus according to claim 8, wherein a plurality of the blowing-out openings are arranged and formed.

10. The printing apparatus according to claim 7, wherein the blowing-out opening is at a predetermined rotation position θ within a range represented by the expression:

$$0°<\theta 90°-\tan^{-1}((R-H)/L)$$

where a reference sign O designates the center of the roller, a reference sign C designates the position of the blowing-out opening, a reference sign B designates a point of contact between the roller and the print medium, a reference sign R designates a radius of the roller, a reference sign L designates a distance between the center of the roller and a suction mechanism provided with the suction opening, H designates a distance between the suction opening of the suction mechanism and the print medium, and θ designates an angle between a line segment OB and a line segment OC.

11. The printing apparatus according to claim 7, wherein a flow rate Fe of gas blown from the roller satisfies the expression $$Fe>Fb+Fd-Fc$$

where Fb is a flow rate of gas discharged from a suction mechanism, and Fd−Fc is a flow rate of gas which does not flow into a region between the suction mechanism and the print medium.

12. The printing apparatus according to claim 7, wherein a flow rate Fe of gas blown from the roller satisfies the expression $$Fe>Fb+Fd+Ff-Fc$$

where Fb is a flow rate of gas discharged from a suction mechanism, Fd−Fc is a flow rate of gas which does not flow into a region between the suction mechanism and the print medium, and Ff is a flow rate of a flow which flows into a region between an adjacent liquid ejection head and the print medium.

* * * * *